US006684538B2

(12) United States Patent
Rumer et al.

(10) Patent No.: US 6,684,538 B2
(45) Date of Patent: Feb. 3, 2004

(54) CUTTING TOOTH FOR A TRENCHER CHAIN

(75) Inventors: Larry James Rumer, Pella, IA (US); John H. Walgren, Lake Havasu City, AZ (US); Jerome Robillard, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 11 days.

(21) Appl. No.: 10/011,247

(22) Filed: Dec. 3, 2001

(65) Prior Publication Data

US 2002/0092209 A1 Jul. 18, 2002

Related U.S. Application Data

(63) Continuation-in-part of application No. 09/708,799, filed on Nov. 8, 2000, now abandoned, which is a continuation of application No. 09/138,792, filed on Aug. 24, 1998, now Pat. No. 6,154,987.

(51) Int. Cl.[7] ..... E02F 9/28

(52) U.S. Cl. ..... 37/465; 37/460; 299/83.1; 299/82.1

(58) Field of Search ..... 37/465, 464, 462, 37/352, 460, 189; 299/34.01, 34.02, 34.03, 34.04, 82.1, 83.1, 84.1, 101; 172/747, 753

(56) References Cited

U.S. PATENT DOCUMENTS

| | | | | | |
|---|---|---|---|---|---|
| 1,550,669 | A | * | 8/1925 | Bowman | 299/83.1 |
| 1,960,879 | A | * | 5/1934 | Russell et al. | 172/713 |
| 2,502,094 | A | | 3/1950 | Kelsey | |
| 2,519,076 | A | | 8/1950 | Schmidt | |
| 2,575,980 | A | | 11/1951 | Simmons | |
| 2,594,990 | A | * | 4/1952 | Protzeller | 37/465 |
| 2,594,991 | A | * | 4/1952 | Protzeller | 37/465 |
| 2,636,291 | A | * | 4/1953 | Reagle | 37/352 |
| 2,702,951 | A | * | 3/1955 | Talboys | 37/104 |
| 2,888,757 | A | | 6/1959 | Sheen | |
| 2,912,774 | A | | 11/1959 | McCrary | |
| 2,946,142 | A | | 7/1960 | Swanson | |
| 3,022,588 | A | | 2/1962 | Brown | |
| 3,063,691 | A | | 11/1962 | Osgood | |
| 3,104,481 | A | | 9/1963 | George et al. | |
| 3,280,486 | A | | 10/1966 | Hackel | |
| 3,305,029 | A | | 2/1967 | Shelton | |
| 3,614,838 | A | | 10/1971 | Wherry | |
| 3,736,676 | A | | 6/1973 | Strugeon | |
| 3,841,709 | A | * | 10/1974 | Kniff | 299/101 |

(List continued on next page.)

FOREIGN PATENT DOCUMENTS

EP 0061299 * 9/1982

OTHER PUBLICATIONS 3 pages of photographs of a cutting tooth used on a Shark Chain® sold by Consolidated Carbide.

*Primary Examiner*—Victor Batson
(74) *Attorney, Agent, or Firm*—Merchant & Gould P.C.

(57) ABSTRACT

The present disclosure relates to a cutting tooth for a trencher chain. The tooth includes a base portion aligned along a first plane. The base portion includes structure for allowing the cutting tooth to be connected to the trencher chain. The tooth also includes a distal portion that is generally obliquely aligned with respect to the first plane. A curved transition is located between the distal portion and the base portion. The curved transition curves away from the first plane and at least partially forms a cupped portion that extends from a leading end to a trailing end of the cutting tooth. The tooth also includes a hardened tip positioned at a region of the leading end that is located farthest from the first plane. The leading edge includes more than one effective configuration.

11 Claims, 11 Drawing Sheets

U.S. PATENT DOCUMENTS 3,846,922 A * 11/1974 Horton ..... 299/82.1
3,856,358 A * 12/1974 Krekeler ..... 299/82.1
3,888,028 A 6/1975 White
3,913,979 A * 10/1975 Strauss et al. ..... 299/84.1
4,294,183 A 10/1981 Morgan
4,571,859 A 2/1986 Leischer
4,626,034 A * 12/1986 Breuer et al. ..... 299/108
4,651,449 A 3/1987 Rose
4,711,503 A * 12/1987 Berchem et al. ..... 299/105
4,776,114 A * 10/1988 Hemphill et al. ..... 37/465
4,819,990 A 4/1989 Breuer et al.
4,883,129 A * 11/1989 Lonn et al. ..... 172/777
4,924,609 A 5/1990 Martin
4,980,980 A 1/1991 Schadov et al.
5,235,961 A 8/1993 McShannon
5,248,188 A 9/1993 Walgren
5,647,448 A 7/1997 Skaggs
6,014,826 A * 1/2000 Walgren et al. ..... 37/456
6,154,987 A * 12/2000 Rumer et al. ..... 37/352
6,270,164 B1 * 8/2001 Seitle et al. ..... 299/82.1
6,421,938 B1 * 7/2002 Kitanaka ..... 37/465

* cited by examiner

CUTTING TOOTH FOR A TRENCHER CHAIN

CROSS REFERENCE TO RELATED APPLICATIONS

This application is a continuation-in-part application of application Ser. No. 09/708,799, filed Nov. 8, 2000, now abandoned, which was a continuation of application Ser. No. 09/138,792, filed Aug. 24, 1998, and issued Dec. 5, 2000 as U.S. Pat. No. 6,154,987. This application claims the benefit of application Ser. No. 09/708,799 and U.S. Pat. No. 6,154,987, both of which are incorporated herein by reference.

FIELD OF THE INVENTION

The present invention relates generally to excavation machines. Specifically, the present invention relates to cutting teeth for use with trencher chains.

BACKGROUND OF THE INVENTION

Trenchers are conventionally used to dig lengths of trenches for laying underground pipe and cable. Most trenchers include a tractor unit equipped with an elongated boom. The boom is typically movable between a raised, generally horizontal position, and a lowered, substantially vertical position. The boom typically includes a cutting chain that is entrained about the boom. The chain generally includes exterior teeth or cutters for engaging the soil. Trenchers also commonly include a conveyer assembly for transporting the soil that is excavated by the chain.

There are various types of cutting teeth or attachments that are commonly bolted to a trencher digging chain. One of the most popular attachments is called a "cup tooth." An exemplary cup tooth cutter is disclosed in U.S. Pat. No. 3,022,588 to Brown. The '588 reference discloses a cup cutter having a leading edge and a cupped portion for scooping loose material from a trench. In use, essentially the entire leading edge of the cup cutter engages the wall of a trench.

Conventional cup tooth cutters, such as the cutter disclosed in the '588 patent, work effectively in easy digging conditions. However, in hard digging conditions, such cutters will generally wear out quickly. Consequently, conventional cup tooth cutters are not effective for excavating hard ground conditions.

SUMMARY OF THE INVENTION

One aspect of the present invention relates to a cutting tooth for a trencher chain. The cutting tooth includes a leading end and a trailing end. The leading end includes at least three regions, each region having a different mechanical/structural characteristic.

A variety of advantages of the invention will be set forth in part in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

Reference will now be made in detail to exemplary aspects of the present invention that are illustrated in the accompanying drawings. Wherever possible, the same reference numbers will be used throughout the drawings to refer to the same or like parts.

Figure 1:
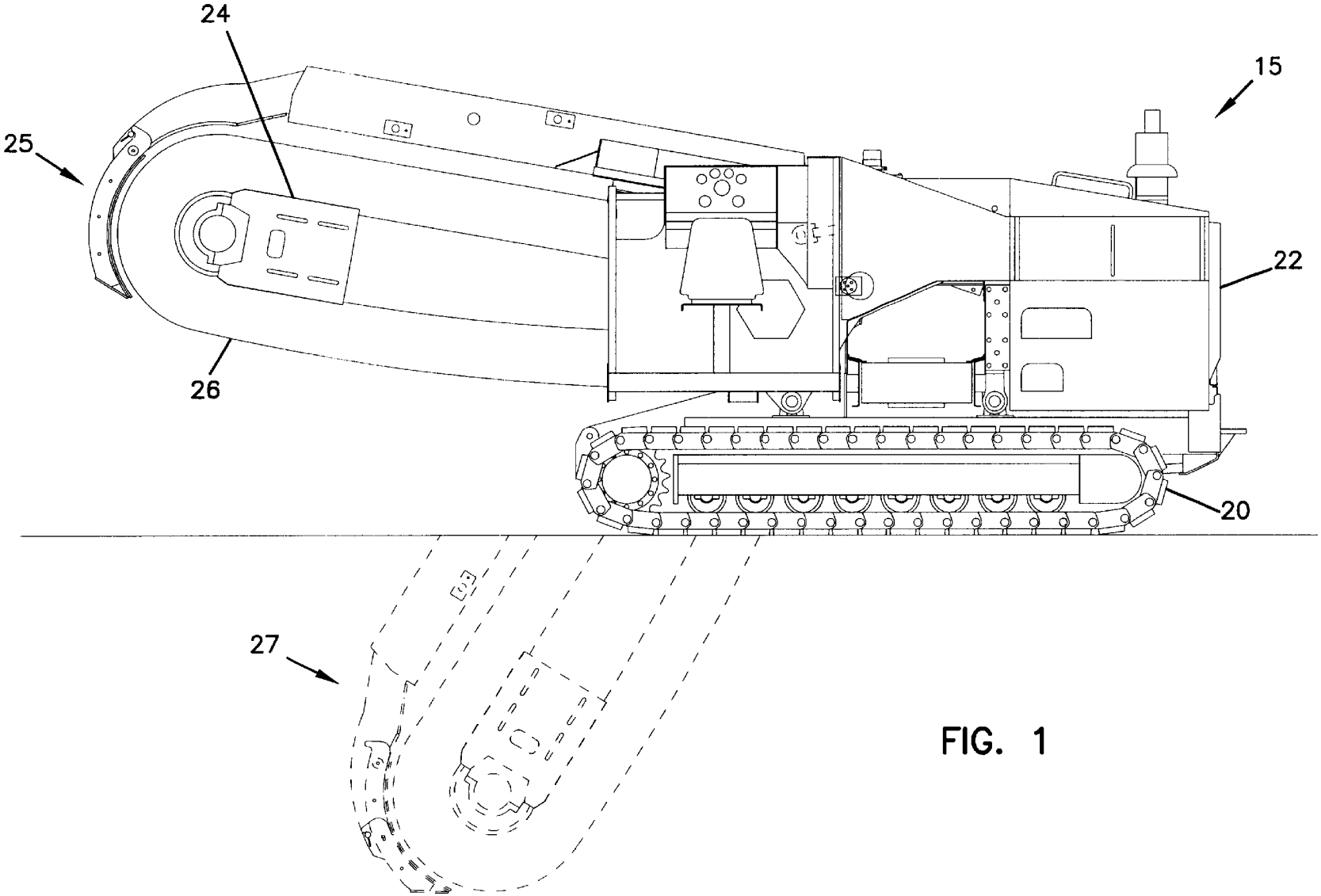
FIG. 1 shows a side view of a trencher.
Figure 2:
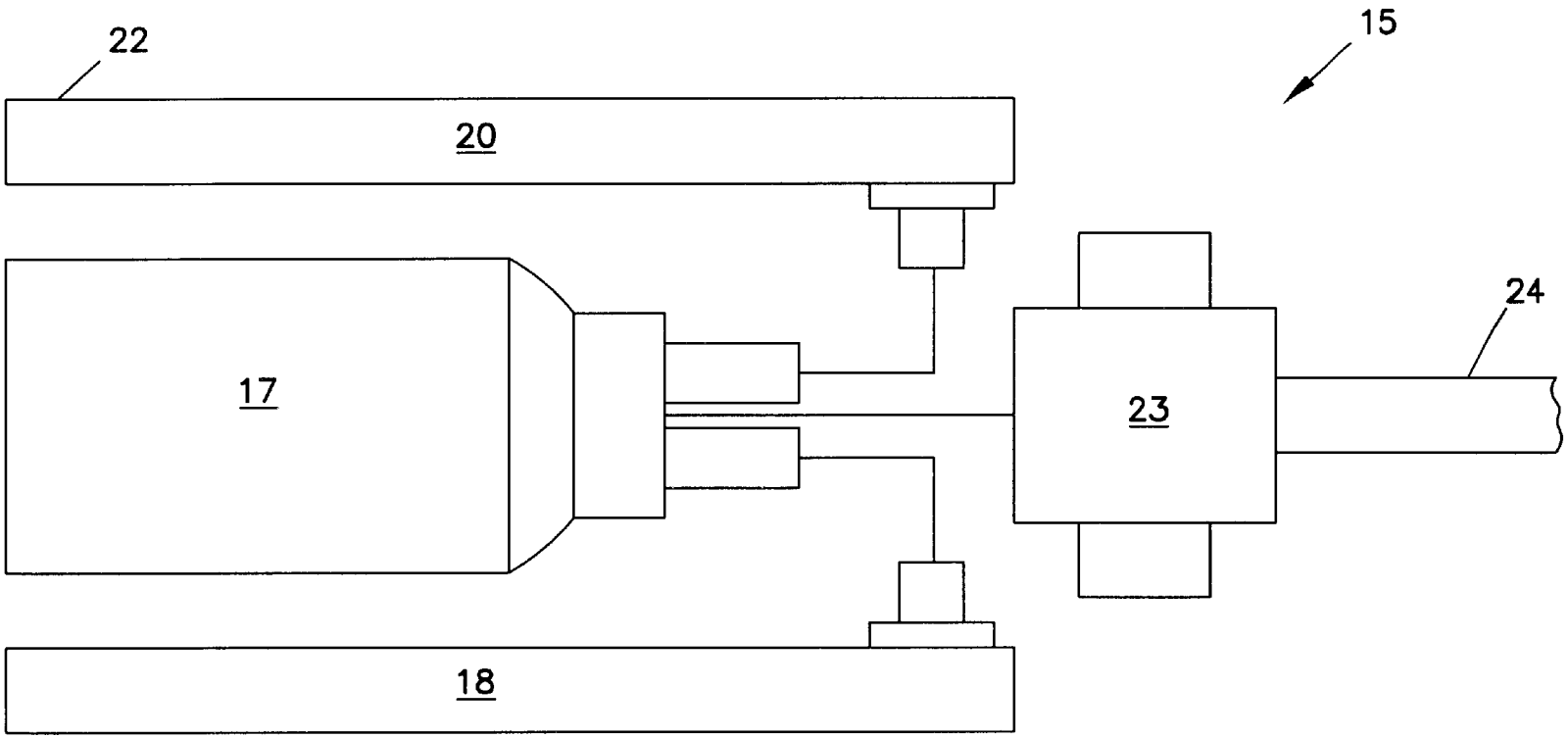
FIG. 2 shows a schematic diagram of the components of the trencher of FIG. 1.

FIGS. 1 and 2 show an exemplary trencher 15. The trencher 15 includes an engine 17 coupled to a right track drive 18 and a left track drive 20, which together form a tractor portion 22 of the trencher 15. A boom 24 is pivotally coupled to the tractor portion 22. A digger chain 26 is mounted on the boom 24. The chain 26 is driven around the boom 24 by a chain drive mechanism 23 powered by the engine 17. The boom 24 is pivotally movable between a substantially horizontal transport configuration 25, and a substantially vertical trenching configuration 27.

When maneuvering the trencher 15 around the work site, the boom 24 is maintained in the transport configuration 25 such that the chain 26 generally remains above the ground. To excavate a trench, the boom 24 is lowered toward the trenching configuration 27 and the chain 26 is driven around the boom 24. When the chain 26 contacts the ground, cutting teeth of the chain 26 penetrate the ground and begin to excavate a trench. Once the boom 24 reaches the trenching configuration 27, the tracks 18 and 20 are engaged causing the tractor 22 to creep forward. The chain 26 digs the trench and removes loose geologic material from the trench as the tractor 22 creeps forward.

The trencher 15 is being disclosed exclusively for the purpose of illustrating an exemplary environment in which the various aspects of the present invention can be applied. It will be appreciated that the variety of trenchers are known in the art, and that the various aspects of the present invention can be applied or used in association with any type of trenching device.

Figures 3A, 3B:
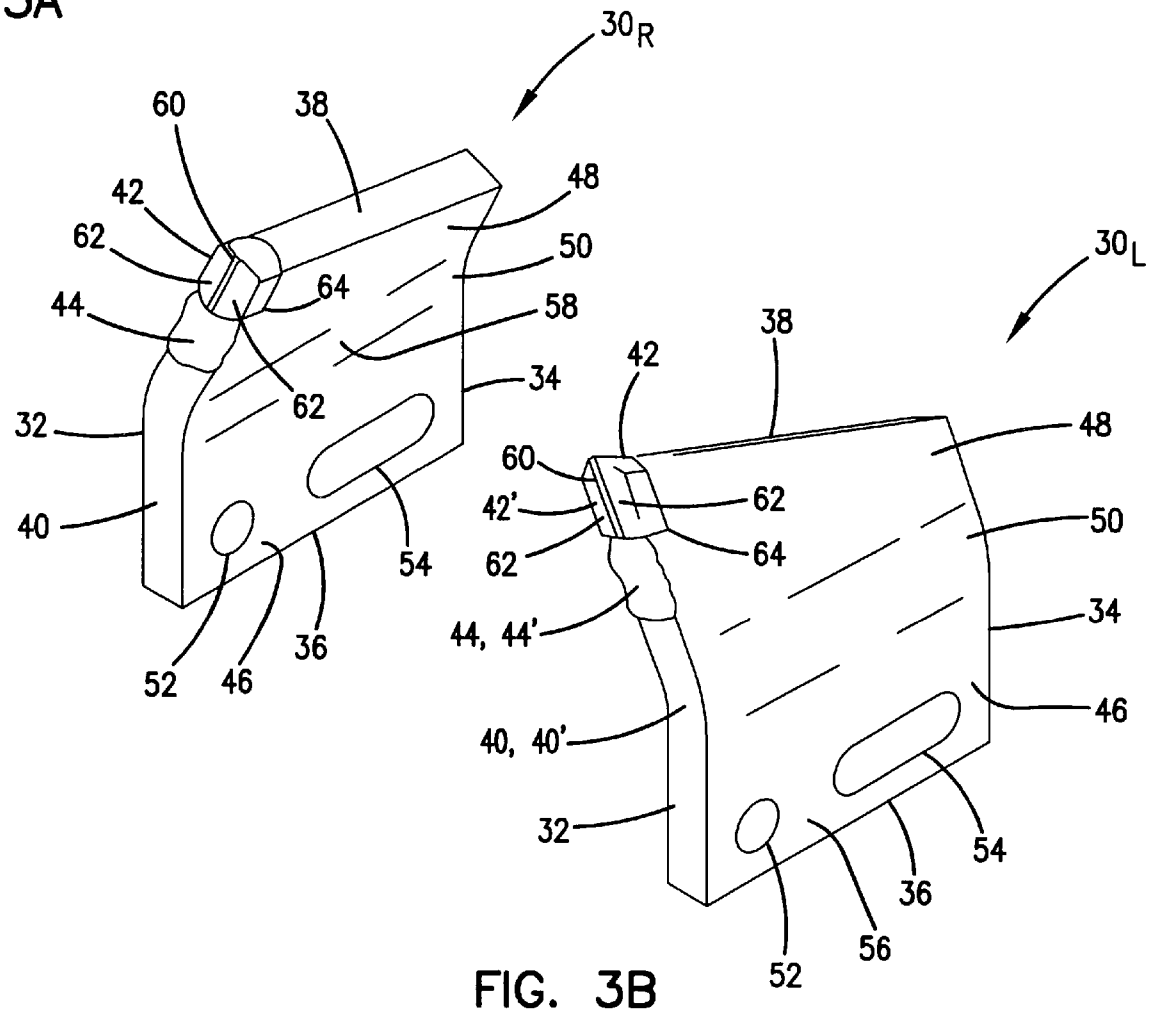
FIG. 3A is a perspective view of one embodiment of a cutting tooth constructed in accordance with the principles of the present invention, the cutting tooth curves to the right when viewed from the leading end of the cutting tooth.
FIG. 3B is a perspective view of another cutting tooth similar to the cutting tooth shown in FIG. 3A, the cutting tooth curves to the left when viewed from the leading end of the cutting tooth.

FIGS. 3A and 3B illustrate cutting teeth $\mathbf{30}_R$ and $\mathbf{30}_L$ that exemplify one embodiment of cutting teeth in accordance with the present invention. The cutting teeth $\mathbf{30}_R$ and $\mathbf{30}_L$ are substantially the same except for the direction of curvature. For example, the cutting tooth $\mathbf{30}_R$ curves to the right when viewed from the leading end of the cutting tooth $\mathbf{30}_R$ as shown in FIG. 3A. By contrast, the cutting tooth $\mathbf{30}_L$ curves to the left when viewed from the leading end of the cutting tooth $\mathbf{30}_L$ as shown in FIG. 3B.

The cutting teeth $\mathbf{30}_R$ and $\mathbf{30}_L$ include leading ends 32 positioned opposite from trailing ends 34. The teeth $\mathbf{30}_R$ and $\mathbf{30}_L$ also include oppositely positioned base ends 36 and distal ends 38 that extend between the leading and trailing ends 32 and 34.

The leading and trailing ends 32 and 34 have generally planar faces or surfaces 40 that are generally parallel to one another (only the faces 40 of the leading ends 32 are shown). Hardened tips 42 are mounted at the interface between the leading ends 32 and the distal ends 38. Hard facing material 44 is positioned along the leading ends 32 directly beneath the hardened tips 42. The hard facing material 44 assists in inhibiting wash wear of the leading ends 32 beneath the hardened tips 42. In this embodiment, the leading edge 32 comprises three differing characteristics: a full width section 40' generally defined by the planar surface 40 of the leading end 32 and extending from the base end 36 to the hard facing material 44; a hard facing material section 44' generally defined by the section of the leading end 32 upon which the hard facing material 44 is positioned; and a tip portion 42' where the hardened tip 42 effectively acts as the leading edge.

What is meant by differing characteristics is that each area is designed to have different operational or functional properties. To illustrate, the planar surface provides a solid foundation for coupling the tooth to the trencher chain and through which force from the trencher is transfer. The hard facing material is positioned at a region against which loosened material impacts, the hard facing material functioning to resist wear. The hardened tip functions as the leading trenching or cutting edge. Additionally each characteristic includes different structural properties. For example, the structural difference may be geometrical, mechanical, or both. The differences may involve cutting characteristics, material properties, differences in widths and profiles, and trenched-material removal characteristics.

The base ends 36 of the teeth $\mathbf{30}_R$ and $\mathbf{30}_L$ extend transversely between the leading and trailing ends 32 and 34. The distal ends 38 of the teeth $\mathbf{30}_R$ and $\mathbf{30}_L$ are aligned at oblique angles with respect to the leading and trailing ends 32 and 34. For example, the distal ends 38 incline from the trailing ends 34 to the leading ends 32. The inclinations of the distal ends 38 form reliefs located behind the hardened tips 42.

Generally, the teeth $\mathbf{30}_R$ and $\mathbf{30}_L$ include base portions 46, distal portions 48, and transition portions 50 located between the base and distal portions 46 and 48. The base portions 46 include circular openings 52 and elongated openings 54 arranged and configured for allowing the teeth $\mathbf{30}_R$ and $\mathbf{30}_L$ to be bolted to a conventional trenching chain. It will be appreciated that alternative bolt hole patterns could also be used.

Figure 4A:
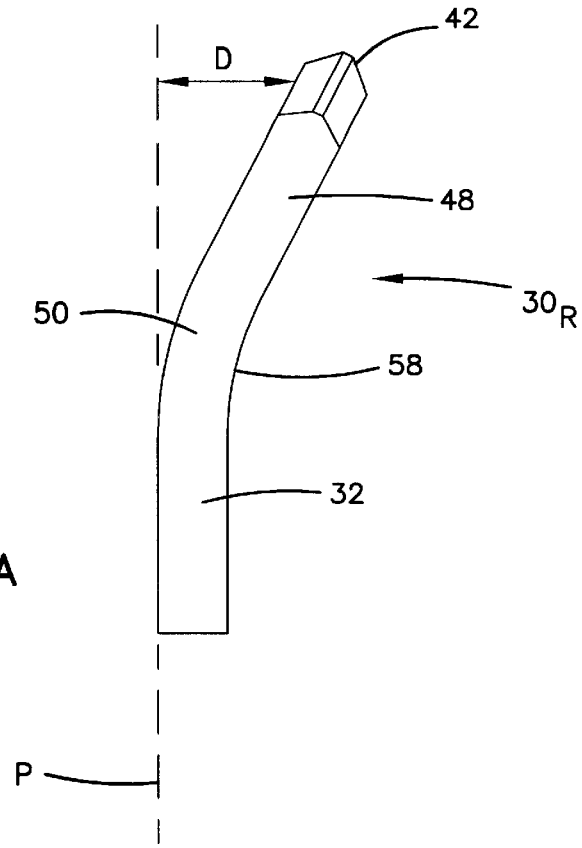
FIG. 4A is a leading end view of the cutting tooth of FIG. 3A.
Figure 4B:
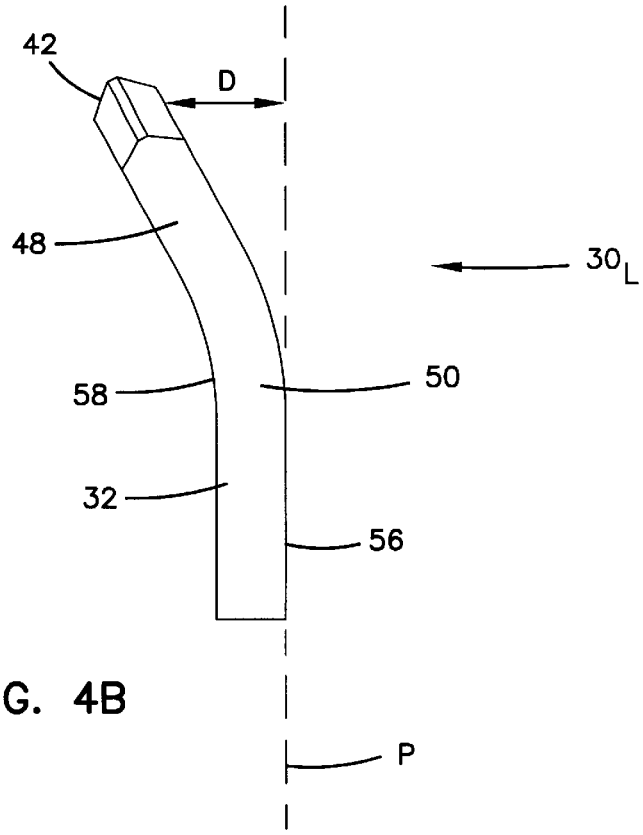
FIG. 4B is a leading end view of the cutting tooth of FIG. 3B.

The base portions 46 include generally planar surfaces 56 that extend between the leading and trailing ends 32 and 34. As shown in FIGS. 4A and 4B, the surfaces 56 are aligned generally along planes P. The transition portions 50 curve away from the planes P and at least partially form cupped portions 58. As shown in FIG. 3A, the cupped portions 58 are located on sides of the teeth $\mathbf{30}_R$ and $\mathbf{30}_L$ that are opposite from the surfaces 56. The cupped portions 58 have generally concave curvatures and preferably extend lengthwise from the leading ends 32 to the trailing ends 34 of the teeth $\mathbf{30}_R$ and $\mathbf{30}_L$. The location of the transition portion 50 and the generally concave nature of the cupped portions 58 facilitates moving or scooping loose geologic material from within a trench. As shown in FIGS. 4A and 4B, the transition portions 50 are located generally at mid regions of the teeth $\mathbf{30}_R$ and $\mathbf{30}_L$.

The distal portions 48 of the teeth 30 are aligned at oblique angles with respect to the planes P. As shown in FIGS. 4A and 4B, the distal portions 48 are substantially straight. However, it will be appreciated that the distal portions 48 could also be curved and still be considered obliquely aligned with respect to the planes P.

Figures 9A, 9B:
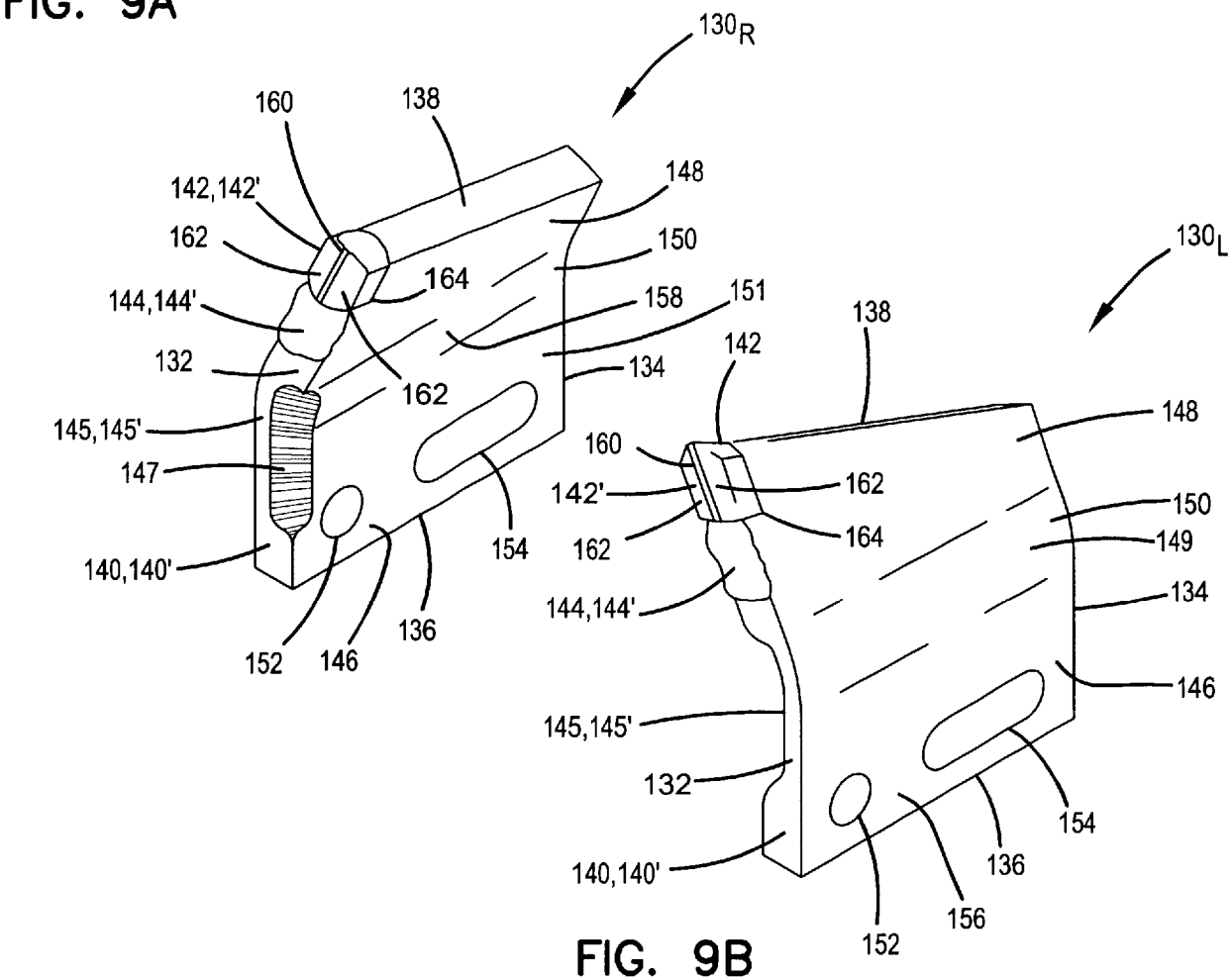
FIG. 9A is a perspective view of another embodiment of a cutting tooth constructed in accordance with the principles of the present invention, the cutting tooth curves to the right when viewed from the leading end of the cutting tooth.
FIG. 9B is a perspective view of another cutting tooth similar to the cutting tooth shown in FIG. 9A, the cutting tooth curves to the left when viewed from the leading end of the cutting tooth.

FIGS. 9A and 9B further illustrate cutting teeth $\mathbf{130}_R$ and $\mathbf{130}_L$ that are alternative embodiments of the present invention. As shown, a leading end 132 may further include a narrowed section 145 located directly beneath the hard facing material 144. What is meant by narrowed is that the section has a cross section or width generally less than the width of the planar surface 140 of the leading end 132. The narrowed section 145 comprises a bevel or tapering area 147 such that the narrowed section 145 of the tapering area 147 effectively acts as a sharpened edge located proximate the leading end 132. Other configurations, such as notches and cupped or concave regions located proximate the leading end, are also contemplated in forming the narrowed section. The presence of this narrowed section or sharpened edge 145 has been found to reduce the power required to utilize the cutting teeth by reducing surface area drag or friction against the leading end of the cutting tooth. Additionally, the sharpened edge 145 assists with the removal of trenched material by providing a tapered pathway or ramp that directs loosened material.

In the illustrated embodiment, the narrowed section 145 is formed by tapering or removing material from only the concave surface 151 of the tooth. The narrowed section 145 may also be formed by tapering only the convex surface 149 of the tooth or by tapering both surfaces 151 and 149. The narrowed section preferably extends from just beneath the hard facing material 144 to just beneath the transition portion 150.

The cutting tooth embodiment of FIGS. 9A and 9B comprises leading edges 132 having four differing characteristics: a full width section 140' generally defined by the planar surface 140 of the leading end 132 and extending from the base end 136 to approximately beneath the transition portion 150; a narrowed, sharpened section 145' located along the transition portion 150 and extending generally adjacent to the hard facing material 144; a hard facing material section 144' generally defined by the leading end 132 upon which the hard facing material 144 is positioned;

and a tip portion 142' where the hardened tip 142 effectively acts as the leading edge. While FIGS. 9A and 9B and the foregoing description relate specifically to a particular leading end configuration of cutting teeth $\mathbf{130}_R$ and $\mathbf{130}_L$, it will be readily apparent that the principles disclosed previously and hereafter with regards to the cutting teeth $\mathbf{30}_R$ and $\mathbf{30}_L$ can also be applied to the cutting teeth $\mathbf{130}_R$ and $\mathbf{130}_L$. To this end, similar components of the cutting teeth $\mathbf{130}_{R,L}$ to that of cutting teeth $\mathbf{30}_{R,L}$ have been similarly referenced in the Figures with reference numbers including a "1" preceding the reference number.

Referring again to FIGS. 4A and 4B, when moving from the base end 35 toward the distal ends 38 of the teeth $\mathbf{30}_R$ and $\mathbf{30}_L$, the entire length of each transition portion 50 extends continuously away from each corresponding plane P. Additionally, the distal portions 48 also extend continuously away from the planes P. Consequently, no portions of the teeth $\mathbf{30}_R$ and $\mathbf{30}_L$ intersect the planes P. In other words, the cutting teeth $\mathbf{30}_R$ and $\mathbf{30}_L$ are located completely on single sides of the planes P. Furthermore, the hardened tips 42 of the teeth $\mathbf{30}_R$ and $\mathbf{30}_L$ are positioned at regions of the leading ends 32 that are located farthest (i.e., a distance D) from the planes P.

The main bodies of the teeth $\mathbf{30}_R$ and $\mathbf{30}_L$ are preferably made of a relatively hard material such as steel. For example, the main bodies of the teeth $\mathbf{30}_R$ and $\mathbf{30}_L$ can be made of steel plates having widths from about 0.375 to 0.750 inches that have been milled or cut into a desired shape, and then pressed or stamped to form a desired curvature.

The hardened tips 42 of the teeth $\mathbf{30}_R$ and $\mathbf{30}_L$ are preferably made of a material that is harder than the material used to form the main bodies of the teeth. For example, the hardened tips 42 comprise solid carbide inlays. As shown in FIGS. 3A and 3B, the hardened tips 42 include leading edges 60 and ramped leading faces 62 located on opposite of the leading edges 60. The hardened tips 42 are mounted within notches 64 that have been milled into the main bodies of the teeth $\mathbf{30}_R$ and $\mathbf{30}_L$. The notches 64 form right angle shoulders located at the interface between the leading and distal ends 32 and 38 of the teeth $\mathbf{30}_R$ and $\mathbf{30}_L$. The hardened tips 42 can be secured within the notches 64 by a brazing process.

Figure 10:
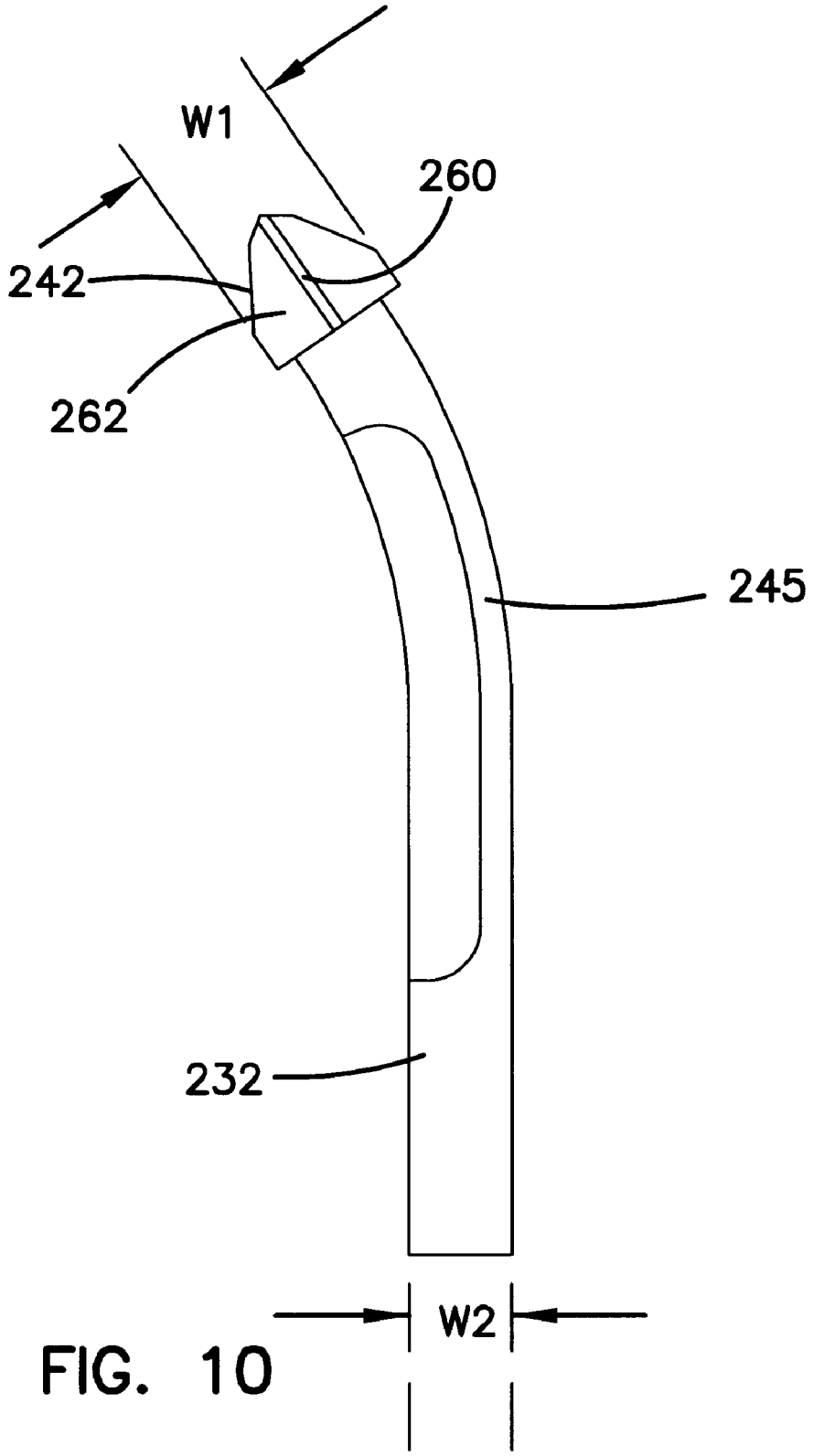
FIG. 10 is a front view of yet another cutting tooth constructed in accordance with the principles of the present invention, the cutting tooth illustrating an alternative embodiment of a cutting tooth tip.
Figure 11:
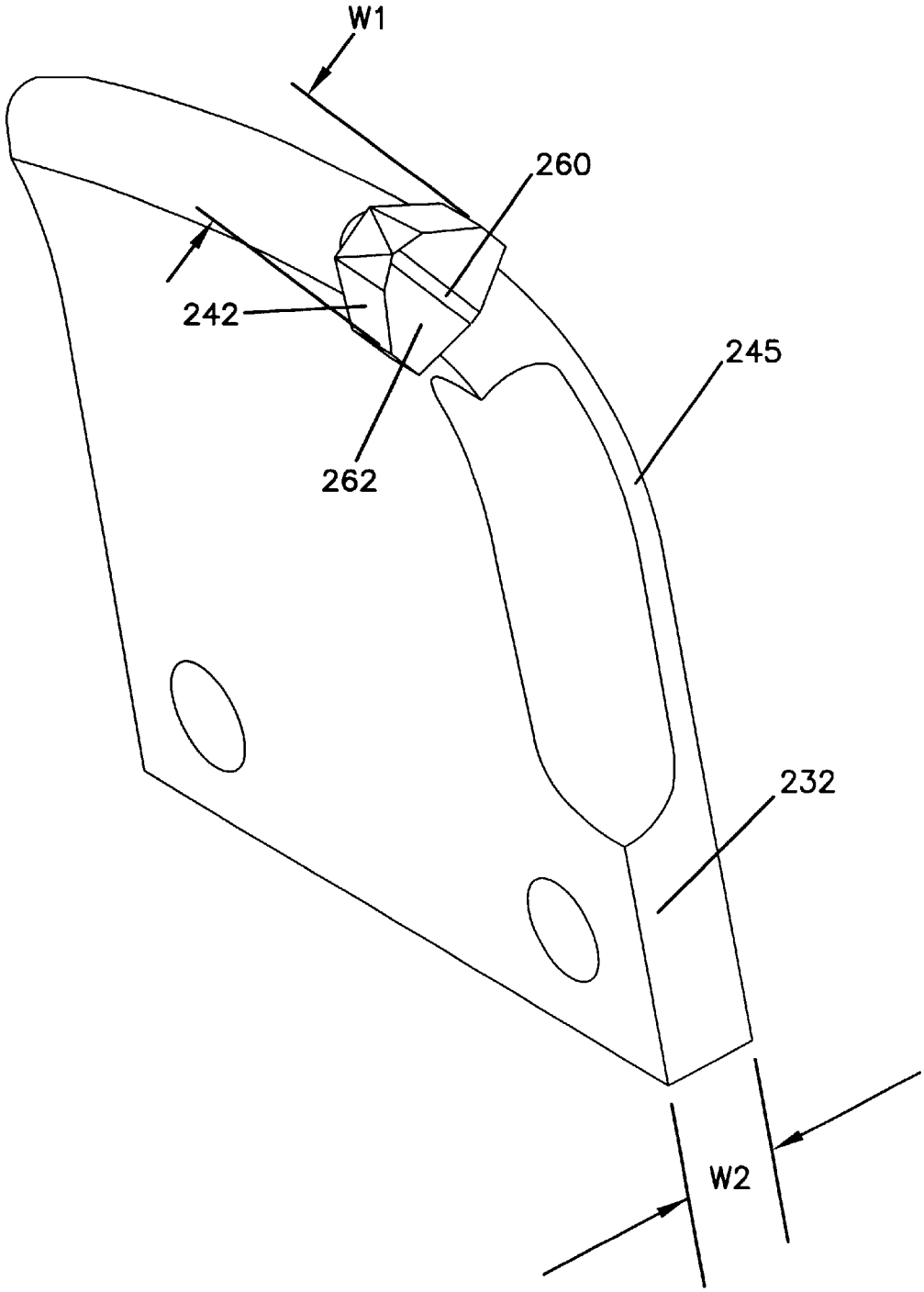
FIG. 11 is a perspective view of the cutting tooth shown in FIG. 10A.

FIGS. 10 and 11 illustrate an alternative embodiment of a hardened tip 242. In this embodiment, hardened tip 242 includes leading edges 260 and ramped leading faces 262. The ramped leading faces 262 have a cross sectional width W1 that is greater than a width W2 of base portion 232. Preferably, the width W1 of hardened tip 242 is at least 10 percent or at least 20 percent greater than the width W2 of the base portion. A hard facing (not shown) may be included between the hardened tip 242 and narrowed section 245. It is to be understood that hardened tip 242 may also be used on a cutting tooth embodiment having a leading end without the narrowed section 245.

Figure 5:
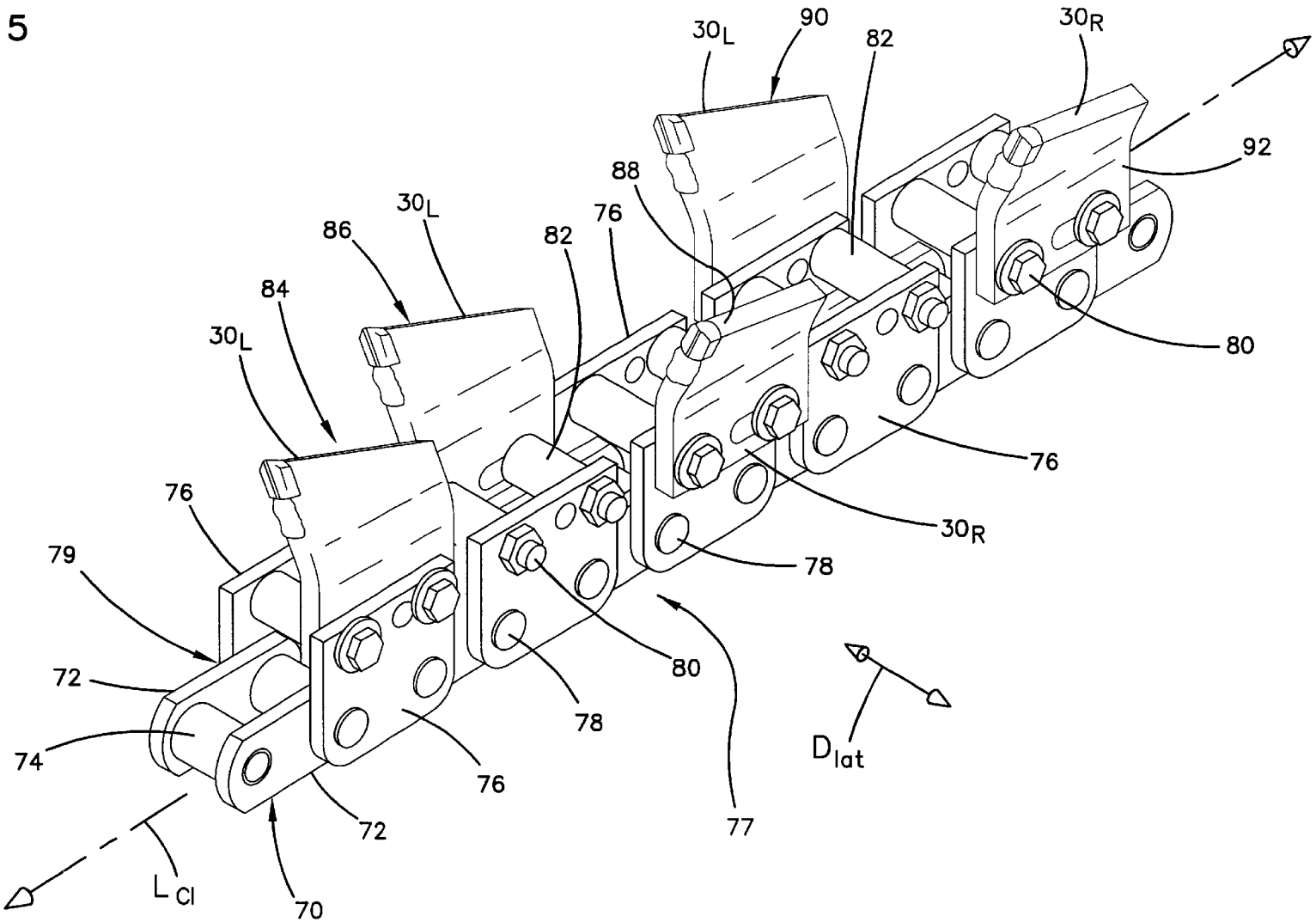
FIG. 5 is a perspective view of an exemplary cutting chain constructed in accordance with the principles of the present invention.

FIG. 5 is a perspective view of an embodiment of a trencher chain 70 constructed in accordance with the principles of the present invention. The chain 70 includes a plurality of side bars 72 aligned generally along a longitudinal centerline $L_{cl}$. The chain 70 also includes a plurality of rollers 74 interconnecting the side bars 72. The rollers 74 are aligned along a lateral dimension $D_{lat}$ that is transverse with respect to the longitudinal centerline $L_{cl}$. Side mounting plates 76 are connected to the chain 70 and extend generally along the side bars 72. For example, the side mounting plates 76 are shown connected to the chain 70 by rivets 78 that extend through the rollers 74. A plurality of the teeth $\mathbf{30}_R$ and $\mathbf{30}_L$ are connected to the side mounting plates 76 by bolts 80 that extend transversely through the side mounting plates 76 and also through the openings 52 and 54 defined by the teeth $\mathbf{30}_R$ and $\mathbf{30}_L$. The bolts 80 also extend through tube spacers 82 positioned between the side mounting plates 76. The tube spacers 82 assist in maintaining lateral spacing between the side mounting plates 76 when the bolts 80 are tightened.

FIG. 5 illustrates five teeth 84, 86, 88, 90, and 92 that are mounted on the chain 70. Tooth 84 is mounted inside the side mounting plates 76 adjacent a first side 77 of the chain 70. Tooth 84 curves laterally toward the longitudinal centerline $L_{cl}$ such that the cupped portions 58 of tooth 84 faces inwardly toward the centerline $L_{cl}$. Tooth 86 is also mounted between or inside the side mounting plates 76, but is located adjacent a second side 79 of the chain 70. Tooth 86 curves laterally away from the longitudinal centerline $L_{cl}$, such that the cupped portion 58 of tooth 86 faces outwardly away from the centerline $L_{cl}$. Tooth 88 is mounted outside the side mounting plates 76, and extends laterally away from the centerline $L_{cl}$ such that the cupped portion 58 of tooth 88 faces outwardly from the chain 70. Tooth 90 is also mounted outside the side mounting plates 76 adjacent the second side 79, and extends laterally away from the longitudinal centerline $L_{cl}$ such that the cupped portion 58 of tooth 90 faces outwardly. Tooth 92 has the same mounting configuration as tooth 88.

Figure 6:
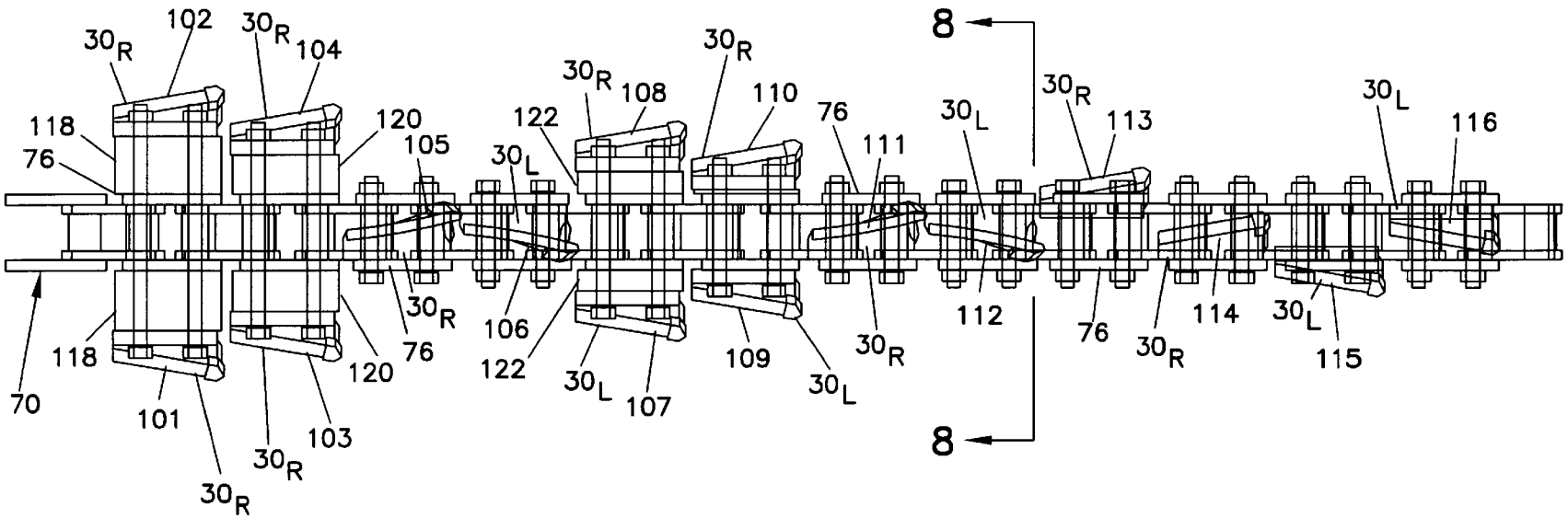
FIG. 6 is a top plan view of a trencher chain having a tooth mounting sequence in accordance with the principles of the present invention.

FIG. 6 is a plan view of an exemplary tooth mounting sequence that can be repeated throughout the length of an exemplary trencher chain. The sequence of FIG. 6 includes 16 cutting teeth 101–116. Cutting teeth 101 and 102 are paired on opposite sides of chain 70. Each of the cutting teeth 101 and 102 curves laterally away from the longitudinal centerline $L_{cl}$. Spacers 118 are used to space the teeth 101 and 102 up to about 6 inches laterally outward from the longitudinal centerline $L_{cl}$.

Teeth 103 and 104 are also spaced on opposite sides of the chain 70, and curve laterally away from the longitudinal centerline $L_{cl}$. Spacers 120 space the teeth 103 and 104 laterally outward from the longitudinal centerline $L_{cl}$. Spacers 120 are less thick than spacers 118 such that teeth 103 and 104 are staggered laterally inward relative to the teeth 101 and 102.

Teeth 105 and 106 are mounted inside the side mounting plates 76 and curve toward the longitudinal centerline $L_{cl}$. Teeth 105 and 106 cooperate to remove loose geologic material from a region of trench located directly beneath the chain 70.

Teeth 107 and 108 are paired on opposite sides of the chain 70 and curve laterally away from the longitudinal centerline $L_{cl}$. Spacers 122 space the teeth 107 and 108 laterally outward from the longitudinal centerline $L_{cl}$. The spacers 122 are thinner than the spacers 120. Consequently, the teeth 107 and 108 are staggered laterally inward relative to the teeth 103 and 104.

Teeth 109 and 110 are also paired on opposite sides of the chain 70, and curve laterally away from the longitudinal centerline $L_{cl}$. The teeth 109 and 110 are mounted outside the side mounting plates 76 and are staggered laterally inward relative to the teeth 107 and 108. Teeth 111 and 112 have the same mounting configurations as the teeth 105 and 106.

Tooth 113 is mounted inside the side mounting plates 76, and curves laterally away from the longitudinal centerline $L_{cl}$. The tooth 113 is staggered laterally inward relative to the tooth 110. Cutting tooth 114 is mounted inside the side mounting plates 76, and curves toward the longitudinal centerline $L_{cl}$. The cutting tooth 114 has substantially the same configuration as cutting teeth 105 and 111.

Cutting tooth 115 is mounted inside the side mounting plates 76, and extends laterally away from the longitudinal centerline $L_{cl}$. The tooth 115 is staggered laterally inward relative to tooth 109. Cutting tooth 116 is mounted inside the mounting plates 76 and curves toward the longitudinal centerline $L_{cl}$. The cutting tooth 116 has a similar mounting configuration to teeth 112 and 106.

Figure 7:
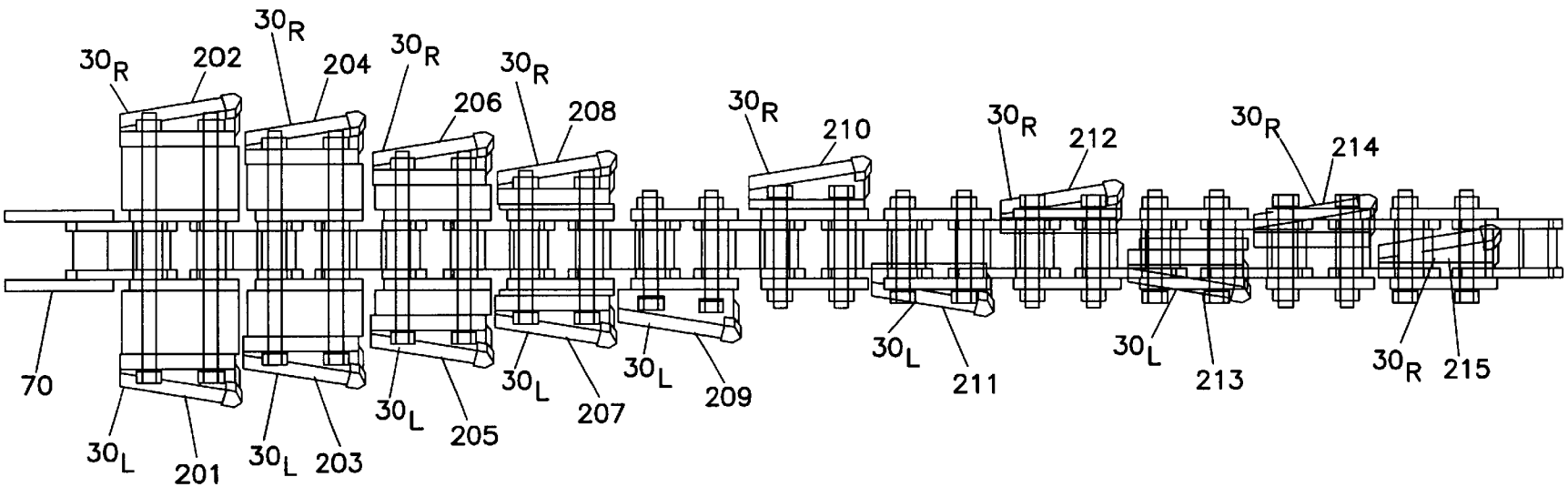
FIG. 7 is a top plan view of a trencher chain having another tooth mounting sequence in accordance with the principles of the present invention.

FIG. 7 illustrates another tooth sequence that can be repeated throughout the length of a trencher chain. The sequence includes 15 teeth 201–215. Teeth 201 and 202 curve outwardly from opposite sides of the chain 70. Teeth 203 and 204 curve outwardly from opposite sides of the chain 70, and are staggered laterally inward relative to the teeth 201 and 202. Teeth 205 and 206 curve outwardly from opposite sides of the chain 70, and are staggered laterally inward relative to teeth 203 and 204. Teeth 207 and 208 curve outwardly from opposite sides of the chain 70, and are staggered laterally inward relative to teeth 205 and 206. Tooth 209 curves outward from the chain 70, and is slightly staggered laterally inward relative to tooth 207. Tooth 210 curves outward from the chain 70, and is slightly staggered laterally inward relative to tooth 208. Tooth 211 curves outwardly from the chain 70, and is slightly staggered laterally inward relative to tooth 209. Tooth 212 curves outwardly from the chain 70, and is slightly staggered laterally inward relative to tooth 210. Tooth 213 curves outwardly from the chain 70, and is staggered laterally inward relative to tooth 211. Tooth 214 curves outwardly from the chain 70, and is staggered laterally inward relative to tooth 212. Finally, tooth 215 curves inwardly towards the longitudinal centerline $L_{cl}$, and is positioned at a mid-region of the chain 70.

Figure 8:
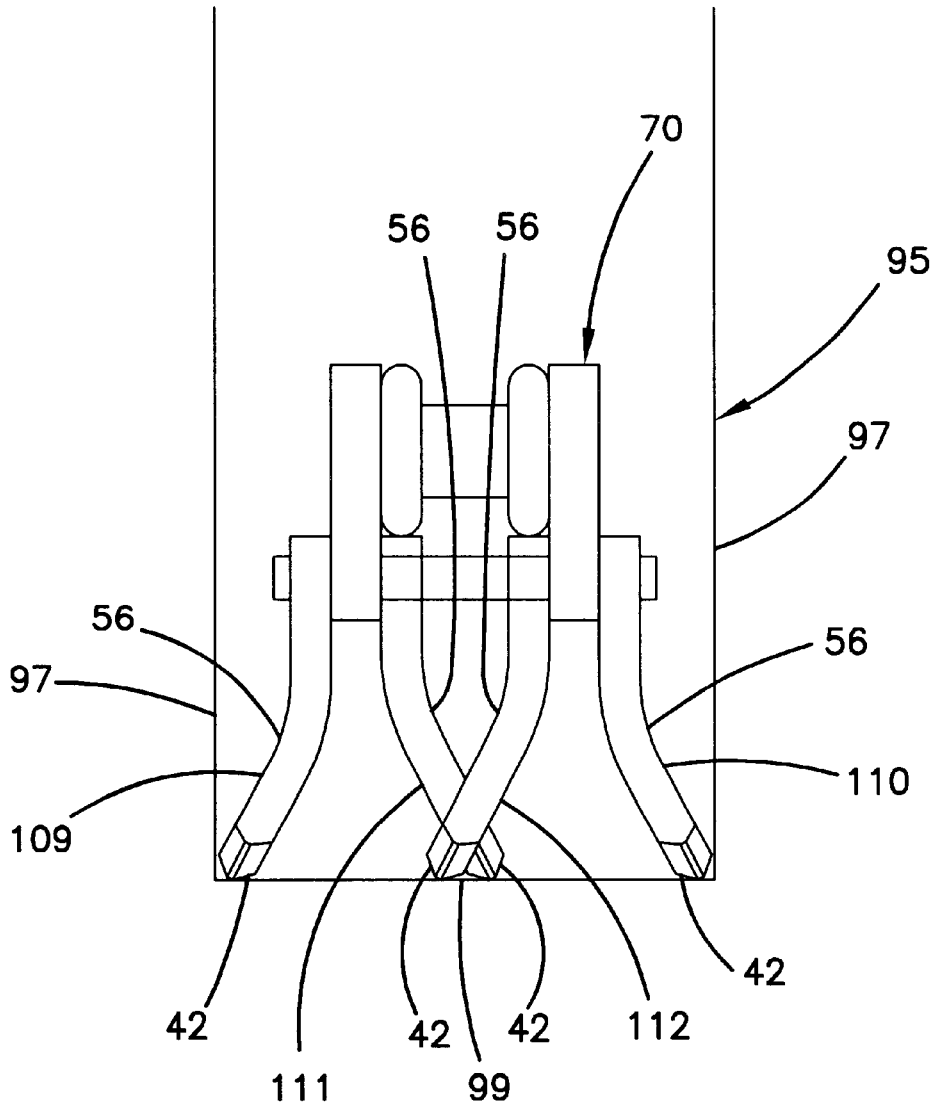
FIG. 8 is a cross-sectional view taken along section line 8—8 of FIG. 6.

FIG. 8 is a schematic cross-sectional view taken along section line 8—8 of FIG. 6. In FIG. 8, the chain 70 is inverted to show the hardened tips 42 engaging the bottom of a trench 95. For example, the hardened tips 42 of teeth 109 and 110 engage side walls 97 and a bottom wall 99 of the trench 95. Only the hardened tips 42 of the teeth 109 and 110 contact the walls 99 and 97 of the trench 95. Consequently, the teeth 109 and 110 resist wear and can be effectively used in hard digging conditions. Also, because only the tips engage the walls of the trench, less power is needed to drive the chain and chains having reduced tensile strengths can be used. For example, chains having tensile strengths in the range of 30,000–300,000 pounds can be used.

In direct contrast to conventional cup tooth cutters, the teeth 109 and 110 have cupped portions 58 that face outward toward the side walls 97 of the trench 95. In use, geologic material loosened by the hardened tips 42 flows between the side walls 97 and the cupped portions 58 of the teeth 109 and 110, and is subsequently scooped from the trench by the cupped portions 58.

The hardened tips 42 of teeth 111 and 112 engage the bottom wall 99 of the trench 95. To maximize wear life, only the hardened tips 42 of teeth 111 and 112 engage the bottom 99 of the trench 95. The cupped portions 56 of teeth 111 and 112 assist in scooping or removing loose geologic material from directly beneath the chain 70.

With regard to the foregoing description, it is to be understood that changes may be made in detail, especially in matters of the construction materials employed and the size, shape and arrangement of the parts with departing from the scope of the present invention. It is intended that the specification and the depicted aspects be considered exemplary only, with a true scope and spirit of the invention being indicated by the broad meaning of the following claims.

We claim:

1. A cutting tooth for use on a trencher chain, the cutting tooth comprising:

a generally rectangular base having a first end and a curved flanged portion having a second end, the base transitioning into the curved flanged portion; and a leading end extending between the first end of the base and the second end of the curved flanged portion, the leading end including:

i) a planar region extending between a first side of the base and a second side of the base, the planar region being located adjacent the first end;

ii) a first narrowed edge located adjacent the second end;

iii) a second narrowed edge located adjacent the planar region; and iv) a hardened region located between the second narrowed edge and the first narrowed edge.

2. The cutting tooth of claim 1, wherein the first narrowed edge is formed by a carbide tip inlay having ramped leading faces.

3. The cutting tooth of claim 2, wherein the second narrowed edge is formed by a tapered region located adjacent the first side of the base.

4. A cutting tooth for a trencher chain, the cutting tooth comprising:

a base portion aligned along a first plane, the base portion including means for allowing the cutting tooth to be connected to the trencher chain;

a distal portion that is generally obliquely aligned with respect to the first plane, the distal portion having generally planar inner and outer surfaces;

a leading end and a trailing end;

a curved transition located between the distal portion and the base portion, the curved transition curving away from the first plane and at least partially forming a cupped portion that extends from the leading end to the trailing end of the cutting tooth; and the leading end including first, second, and third sections wherein:

i) the first section includes a planar region having a first width, the first width being substantially perpendicular to the first plane;

ii) the second section includes a hardened tip mounted within a notch defined by the distal portion and positioned at a region of the leading end that is located farthest from the first plane; and iii) the third section includes a hard facing positioned along the leading end adjacent to the hardened tip.

5. The cutting tooth of claim 4, wherein the leading end further comprises a fourth section, the fourth section including a narrow region located along the leading end adjacent the hard facing.

6. The cutting tooth of claim 5, wherein the narrow region has a second width less than the first width of the planar region.

7. The cutting tooth of claim 5, wherein the fourth section is formed by a concave region formed adjacent the curved transition, the narrowed region further comprising a sharpened edge.

8. A cutting tooth for use on a trencher chain, the cutting tooth comprising:

a base, the base having a coupling location for coupling the base to the trencher chain;

a trailing end and a leading end, the leading end comprising:

i) a hardened tip located opposite the base of the tooth;

ii) a first edge and an opposite second edge;

ii) a cut-away formed along the first edge of the leading end, the cut-away including a non-stepped ramp that tapers from a side of the tooth to the leading end of the tooth to direct loosened material; and iv) a narrowed section located along the second edge of the leading end.

9. The cutting tooth of claim 8, further including a hard facing surface located between the hardened tip and the cut-away formed along the first edge of the leading end.

10. The cutting tooth of claim 8, further including a distal end opposite the base and a curved region positioned between the distal end and the base.

11. The cutting tooth of claim 10, wherein the cut away portion is at least partially located on the curved region of the cutting tooth.

* * * * *

UNITED STATES PATENT AND TRADEMARK OFFICE

CERTIFICATE OF CORRECTION

PATENT NO. : 6,684,538 B2
DATED : February 3, 2004
INVENTOR(S) : Rumer et al.

It is certified that error appears in the above-identified patent and that said Letters Patent is hereby corrected as shown below:

Title page,
Item [56], References Cited, U.S. PATENT DOCUMENTS, "3,736,676" reference, "Strugeon" should read -- Sturgeon --

Column 9,
Line 1, "ii) a cut-away" should read -- iii) a cut-away --

Signed and Sealed this

Twenty-eighth Day of December, 2004

JON W. DUDAS
*Director of the United States Patent and Trademark Office*